US007011920B2

(12) United States Patent
Nagai et al.

(10) Patent No.: US 7,011,920 B2
(45) Date of Patent: Mar. 14, 2006

(54) NON-MAGNETIC MONO-COMPONENT TONER AND DEVELOPING METHOD WITH THE SAME

(75) Inventors: Takafumi Nagai, Higashiosaka (JP); Tadayuki Sawai, Nara (JP); Toshihisa Ishida, Kashiba (JP); Kouji Kida, Kitakatsuragi-gun (JP); Kazuya Korematsu, Nara (JP); Toru Nishikawa, Yamatokoriyama (JP); Yoshimi Kojima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 174 days.

(21) Appl. No.: 10/704,755

(22) Filed: Nov. 12, 2003

(65) Prior Publication Data

US 2004/0096764 A1 May 20, 2004

(30) Foreign Application Priority Data

Nov. 14, 2002 (JP) ..... 2002-330351

(51) Int. Cl.
*G03G 9/00* (2006.01)

(52) U.S. Cl. ..... 430/108.1; 430/111.4; 430/120

(58) Field of Classification Search ..... 430/108.1, 430/111.4, 120

See application file for complete search history.

(56) References Cited

U.S. PATENT DOCUMENTS 3,983,045 A * 9/1976 Jugle et al. ..... 430/108.1

FOREIGN PATENT DOCUMENTS

| | | |
|---|---|---|
| JP | 2754539 B2 | 5/1998 |
| JP | 2759532 B2 | 5/1998 |
| JP | 3127323 B2 | 1/2001 |

OTHER PUBLICATIONS

Patent Abstracts of Japan 64-010269, Jan. 13, 1989.
Patent Abstracts of Japan 03-177848, Jul. 1, 1991.
Patent Abstracts of Japan 06-089044, Mar. 29, 1994.

* cited by examiner

*Primary Examiner*—Mark A. Chapman
(74) *Attorney, Agent, or Firm*—Nixon & Vanderhye P.C.

(57) ABSTRACT

A non-magnetic mono-component toner of the present invention is composed of a coloring powder at least containing a binder resin, coloring agent and wax and at least one kind of external additive having a mean particle diameter of 0.04 μm or greater, wherein the relationship between the Vickers hardness of the above coloring powder and the mean particle diameter of the external additives satisfies the predetermined expression. Thereby, the present invention is effective in preventing the external additive particles from sinking into the toner surface as well as from falling off from the surface when the toner particles are stressed in the developing unit. As a result, it is possible to provide stable image quality free from degradation of toner charge performance and toner supply performance even for long-term use.

4 Claims, 1 Drawing Sheet

NON-MAGNETIC MONO-COMPONENT TONER AND DEVELOPING METHOD WITH THE SAME

BACKGROUND OF THE INVENTION (1) Field of the Invention

The present invention relates to a mono-component developing method for use in an image forming apparatus such as an electrostatic copier, laser beam printer etc., which uses electrophotography, more detailedly, relating a mono-component developer and mono-component developing method for use in a non-magnetic developing system in which a toner image is formed by contacting a developer support to a static latent image support.

(2) Description of the Prior Art

The image forming process using electrophotography implements image forming by the steps of charging, exposure, development, transfer and fixing. In the charging step, uniform charging is performed on the photoconductor surface containing photoconductive material. In the exposure step, an electrostatic latent image is formed on the photoconductor surface by exposure of the photoconductor. In the developing step, the static latent image on the photoconductor surface is visualized by the developer, forming a toner image. In the transfer step, the toner image on the photoconductor surface is transferred to a sheet. In the fixing step, the toner image is fixed to the sheet by heating, pressing and/or other means.

In the above different steps, as the developing system used in the developing step, the dual component developing system using a two-component developer composed of toner and carrier and the mono-component developing system using a single component developer made up of toner only, not containing carrier are generally known. Of these systems, the mono-component developing system is widely used from the viewpoints of maintenance, compactness, light-weight configuration, low-cost configuration etc.

The mono-component developing system is classified into the mono-component developing system using magnetic toner and the non-magnetic mono-component developing system using non-magnetic toner. Since the former uses toner added with magnetic material which is a black powder, a non-magnetic mono-component developing system is preferable for color image forming.

On the other hand, in the latter system, i.e., the non-magnetic mono-component developing system, the toner is liable to be degraded due to stress, hence the image quality is lowered due to long usage. Further, there is a problem that the degraded toner causes filming over the developing roller (developer support) and photoconductor (electrostatic latent image support). Here, 'filming' means fusion of toner or part of the toner composition to the surface of the developing roller or the photoconductor.

In effect, in the non-magnetic mono-component system, a doctor blade (film thickness control member) for regulating the amount of toner supported on and conveyed by the developing roller surface is provided along the longitudinal axis of the developing roller so as to oppose and abut the developing roller. The toner supported on the developing roller is adapted to pass through the nip between the developing roller and the doctor blade so as to form a uniform thin layer of toner (referred to as a toner layer) while the toner is triboelectrically charged. Accordingly, the doctor blade is abutted against the developing roller with a pressure which can triboelectrically charge the toner.

When the toner passes through the nip between the developing roller and the doctor blade, a strong stress acts on the toner, the toner being degraded. In the stressed toner, external additives (added agents to the base component in order to enhance the fluidity of the toner) may sink into the base toner (coloring powder) constituting the toner, or conversely the additives may come off from the base toner (coloring powder). As a result, the fluidity of the toner lowers or the cohesive force of the toner increases, causing the toner to fuse onto the developing roller and photoconductor, i.e., filming. Toner fusion to the doctor blade may also take place.

As the prior art for solving this problem, Japanese Patent No.2754539, Japanese Patent No.2759532 and Japanese Patent No.3127323 have proposed methods of adding an external additive of relative large-sized particles to the base toner. These patent publications disclose that the problems of the charge performance, fluidity or agglomeration etc., can be prevented.

It is true that each method of the aforementioned publications is effective in preventing lowering of the fluidity and filming by using an external additive of relative large-sized particles, but the external additive particles separated from the base toner build up on the developing roller surface, supply roller surface etc., causing gradual degradation of image quality from long term use.

Further, in recent years, there are demands for energy saving, color imaging, and oil-less fixing configurations in color imaging machines. In order to meet the needs, binder resins having relatively low softening temperatures and low melting point waxes are used for toner materials. While on one hand the particles of low melting point toner composed of low melting point resin and wax may present good performance in low-temperature fixing, the hardness of the particle surface of the toner is soft under usual temperature (under room temperature).

When such a low melting point toner is used as a non-magnetic mono-component developer, external additives are liable to sink into the toner particle surface, hence it is necessary to use large amounts of external additives of relative large-sized particles in order to prevent lowering of fluidity. As a result, the low-temperature fixing performance, which is the expected performance of a low-melting point toner, degrades. Therefore, it has been difficult to provide a toner which presents low-temperature fixing performance, prevention against degradation of fluidity due to embedment of external additive particles and prevention against instability of toner charging and supply due to buildup of separated external additive particles.

SUMMARY OF THE INVENTION

The present invention has been devised in view of the above conventional problems, it is therefore an object of the present invention to provide anon-magnetic mono-component developer and non-magnetic mono-component developing method, wherein degradation of toner charge performance and toner supply performance from long term use can be suppressed so that stable image quality can be obtained. It is another object to provide a non-magnetic mono-component developer and non-magnetic mono-component developing method, which are suitable for image forming apparatuses including a color image forming apparatus, energy saving fixing device or oil-less fixing device.

The inventors hereof found that the above problems can be solved by the use of a non-magnetic mono-component toner composed of a coloring powder at least containing a binder resin, coloring agent and wax and at least one kind of external additive having a mean particle diameter of 0.04 μm or greater, wherein the relationship between the Vickers hardness of the above coloring powder and the mean particle diameter of the external additives is represented by the following expression:

$$21 \leqq A^2 \times B \leqq 195 \quad \text{(Eq.1)}$$

A: the Vickers hardness of the coloring powder

B: the mean particle diameter (μm) of the external additives, and have completed the present invention.

Further, the non-magnetic mono-component toner of the present invention is more effective when used in anon-magnetic mono-component developing method which uses a developer support for bearing a thin layer of a toner on the surface thereof, a layer thickness control member arranged in abutment with the developer support for making the thickness of the thin layer held on the developer support surface uniform, and brings the developer support into contact with an electrostatic latent image support on which an electrostatic latent image is formed so as to develop the electrostatic latent image.

DESCRIPTION OF THE PREFERRED EMBODIMENTS

Figure 1:
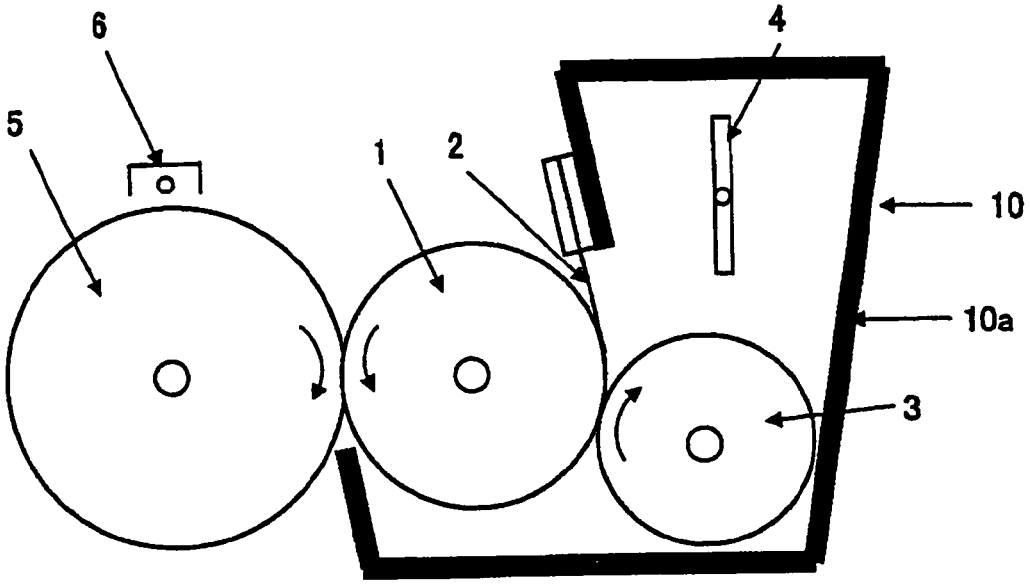
FIG. 1 is a sectional view showing essential parts of a developing portion in the image forming process unit in the embodiment of the present invention.

A non-magnetic mono-component toner according to the present invention is composed of a coloring powder at least containing a binder resin, coloring agent and wax and at least one kind of external additive having a mean particle diameter of 0.04 μm or greater. The relationship represented by the following expression 1 holds between the Vickers hardness of the above coloring powder and the mean particle diameter of the external additives:

$$21 \leqq A^2 \times B \leqq 195 \quad \text{(Eq.1)}$$

A: the Vickers hardness of the coloring powder

B: the mean particle diameter (μm) of the external additives

Here, the reason for limiting the value of $A^2 \times B$, calculated from the Vickers hardness of the coloring powder and the mean particle diameter of the external additives, within 21 to 195 is described as follows. That is, if this value is smaller than 21, the particle diameter of the external additives is small compared to the hardness of the base toner (coloring powder) surface, so that the external additive particles are liable to sink when the toner particles are stressed in the developing unit. Resultantly, toner charge performance and fluidity will change. When the value of $A^2 \times B$ exceeds 195, the particle diameter of the external additives is great compared to the hardness of the base toner (coloring powder) surface, so that it is difficult to hold the external additives on the toner surface. Resultantly, the additive particles are easily separated from the toner surface and build up in the developing unit. The reason for limiting the mean particle diameter of the external additives to being 0.04 μm or greater is that, if the particle diameter is smaller than 0.04 μm, prevention against lowering of fluidity and occurrence of filming cannot be effectively obtained in the non-magnetic mono-component developing system.

Thus, it is believed that the above configuration can prevent the external additive particles from sinking into the toner surface and from dislodging even when the toner particles are stressed in the mono-component developing unit. Though the mechanism of inhibiting separation of the external additive particles is not definite, it is understood that the combination of an appropriate toner surface hardness with a suitable additive particle size makes it possible for the external additive particles to sink into the coloring powder surface to a small degree, but still producing strong adhesion when the toner particles are stressed. As a result, it is possible to obtain a non-magnetic mono-component toner which is suppressed from degradation of toner charge performance and toner supply performance and can maintain stable image quality for long term use.

Even when a low softening temperature resin or a low melting point wax is used as the toner material, use of external additives having a particle diameter in conformity with the above configuration makes it possible to achieve stabilized toner charge performance and supply performance in parallel without degrading low temperature fixing performance.

In the mono-component developer of the present invention, in order to enhance the developer's fluidity originating from gravity, a micro powder having a diameter of 0.03 μm or lower is preferably added as the second external additive to the toner.

The mono-component developer should maintain its fluidity when it is stressed and also needs to have fluidity under conditions where no stress is acted. That is, in order to enable smooth toner supply from the toner cartridge or the toner hopper to the developing roller, the inherent fluidity of the toner (the self-weight fluidity) has to be high. If the toner has a low self-weight fluidity, the toner stagnates inside the toner cartridge or inside the toner hopper due to the bridge phenomenon or other reasons, and the toner cannot be supplied to the developing roller and the supplying roller. There is a method of adding an abundant amount of large-diametric external additive particles in order to enhance the self-weight fluidity. However, since there is a tendency for fixing performance to lower as the added amount of external additive is increased, it is preferred that a micro powder having a diameter of 0.03 μm or lower is added as the second external additive to the toner.

The Vickers hardness of the coloring powder can be determined by the measurement based on JIS B7725 and JIS Z2244 of a solidified sample which is obtained by fusing the coloring powder in a 180° C. oven and leaving the fusion at room temperature.

Measurement of the Vickers hardness can be implemented by a method using a Vickers hardness tester or a dynamic ultra micro hardness tester.

The toner's Vickers hardness is affected by various factors such as the binder resin or the wax in the toner. Particularly, it is greatly affected by the molecular weight distribution of the binder resin and the melting point of the wax. Specifically, if the toner's Vickers hardness needs to be lower, the content of copolymers of low molecular weights across the molecular weight distribution of the binder resin may be increased or low melting point waxes (providing the function of a plasticizer) may be used. Conversely, if the Vickers hardness needs to be higher, the content of copolymers of high molecular weights across the molecular weight distribution of the binder resin may be increased or the gel content (the content ratio of cross-linked high polymers that are insoluble in THF) may be increased.

The external additive used in the present invention is not particularly limited as long as it satisfies the above relation of Eq.1. For example, fine powders of silica such as wet-process silica, dry-process silica, titanium oxide, aluminum oxide, inorganic micro particles obtained by subjecting one of these to a surface treatment with a silane coupling agent, titanium coupling agent or silicone oil, fatty acid metal salt, zinc stearate, calcium stearate, lead stearate, zinc oxide powder, fine powders of fluoric resin such as fine powder of vinylidene fluoride, fine powder of polytetrafluoroethylene, etc. can be considered.

The second external additive used in combination for the purpose of enhancing self-weight fluidity is a powder having a particle diameter of 0.03 $\mu$m or smaller, and examples include fine silica powder such as dry-process silica, titanium oxide, aluminum oxide, inorganic micro particles obtained by subjecting one of these to a surface treatment with a silane coupling agent, titanium coupling agent or silicone oil.

The external additives are preferably added in an amount of 0.3 to 3 parts by weight to 100 parts by weight of the base toner. If the added amount is lower than 0.3 part by weight, it is difficult to secure the necessary fluidity when the toner is stressed. The added amount exceeding 3 parts by weight will cause degradation of fixing performance.

It is also possible to add a fine abrasive powder to the toner. As the specific examples, fine abrasive powders such as strontium titanate, cerium oxide, silicon carbide, magnetite can be considered. These fine powders may also be used in a form treated by a coupling agent such as a silane coupling agent, titanium coupling agent, silicone oil or other organic compounds. The fine abrasive powder should have a particle diameter falling within the range of 0.04 to 5 $\mu$m. The fine abrasive powder is preferably added in an amount of 2 parts or lower by weight to 100 parts by weight of the toner particles because excessive addition causes too fast abrasion of the electrostatic latent image support surface and the developer support surface.

Examples of the binder resin used for the toner of the present invention include: styrene compound resins (homopolymers or copolymers including styrene or a styrene-substituted product) such as polystyrene, poly p-chlorostyrene, poly $\alpha$-methyl styrene, styrene-chlorostyrene copolymers, styrene-propylene copolymers, styrene-butadiene copolymers, styrene-vinyl chloride copolymers, styrene-vinylacetate copolymers, styrene-maleic acid copolymers, styrene-acrylate copolymers(styrene-methyl acrylate copolymers, styrene-ethyl acrylate copolymers, styrene-butyl acrylate copolymers, styrene-octyl acrylate copolymers, styrene-phenyl acrylate copolymers, etc.), styrene-methacrylate copolymers (styrene-methyl methacrylate copolymers, styrene-ethyl methacrylate copolymers, styrene-butyl methacrylate copolymers, styrene-octyl methacrylate copolymers, styrene-phenyl methacrylate copolymers, etc.), styrene-$\alpha$-methyl chloroacrylate copolymers and styrene-acrylonitrile-acrylate copolymers; polyvinyl chloride; low molecular weight polyethylene; low molecular weight polypropylene; ethylene-ethylacrylate copolymers; polyvinyl butyral; ethylene-vinylacetate copolymers; rosin-modified maleic acid resin; phenol resin; epoxy resin; polyester resin; ionomer resin; polyurethane resin; silicone resin; ketone resin; xylene resin; and polyamide resin. These may be used alone or in combination of two or more kinds. For full-color toner, polyester resin is preferred from the viewpoint of heat characteristic control.

Examples of the waxes used for the toner of the present invention include: aliphatic hydrocarbon waxes such as low molecular weight polyethylene, low molecular weight polypropylene, micro-crystalline waxes, paraffin waxes; oxides of aliphatic hydrocarbon waxes such as polyethylene oxide waxes or their block copolymers; waxes mainly consisting of fatty acid esters, such as carnauba wax, sasol wax, montan acid ester wax; and those of fatty acid esters which are deoxidated partly or as a whole, such as deoxidated carnauba wax.

In order to achieve improved low-temperature fixing performance, micro-crystalline wax, carnauba wax, rice wax and montan wax, having a melting point of 60 to 90° C. are preferred. The added amount of wax is 0.1 to 20 parts by weight, preferably 0.5 to 10 parts by weight to 100 parts by weight of the binder resin.

As the coloring agents used for the toner of the present invention, various kinds of coloring agents can be used in correspondence to yellow (Y), magenta (M) and cyan (C) and black.

As a coloring agent for yellow (Y) toner, for example, azo pigments such as CI pigment yellow 1, CI pigment yellow 5, CI pigment yellow 12, CI pigment yellow 15 and CI pigment yellow 17 based on the Color Index, inorganic pigments such as iron oxide yellow and ochre can be considered. As a dye, for example, nitro dyes such as CI acid yellow 1, oil soluble dyes such as CI solvent yellow 2, CI solvent yellow 6, CI solvent yellow 14, CI solvent yellow 15, CI solvent yellow 19 and CI solvent yellow 21 can be considered. Of these, benzine soluble pigments such as CI pigment yellow 17 are preferably and desirably used with regard to tone and hue as a yellow coloring agent.

As a coloring agent for magenta (M) toner, for example, CI pigment red 49, CI pigment red 57, CI pigment red 81, CI pigment red 122, CI solvent red 19, CI solvent red 49, CI solvent red 52, CI basic red 10, CI disperse red 15 and the like can be considered. Of these, quinacridone pigments such as CI pigment red 122 are preferably used with regard to tone and hue as a red coloring agent.

As a coloring agent for cyan (C) toner, for example, CI pigment blue 15, CI pigment blue 16, CI solvent blue 55, CI solvent blue 70, CI direct blue 25, CI direct blue 86 can be considered. Of these, copper phthalocyanine pigments such as CI pigment blue 15 are preferably used with regard to tone and hue as a cyan coloring agent.

As a coloring agent for black toner, carbon black is preferably used.

The added amount of the coloring agent is 1 to 30 parts by weight, preferably 2 to 10 parts by weight to 100 parts by weight of the binder resin. When the added mount of the coloring agent is less than 1 part by weight, there are cases where desired image density cannot be obtained. Conversely, when the added amount of the coloring agent exceeds 30 parts by weight, in some cases, fixing performance might be degraded.

For the purpose of controlling tribo-charge performance, the toner of the present invention may contain some charge control agents. There are two types of charge control agents, i.e., that for positive charge control and that for negative charge control depending on the necessary toner charge characteristic. As a charge control agent for positive charge control, organic compounds containing basic nitrogen atoms such as basic dyes, quaternary ammonium salts, aminopyrine, pyrimidine compounds, polynuclear polyamino compounds, aminosilanes, nigrosine base and the like can be considered. As a charge control agent for negative charge control, oil-soluble dyes such as oil black and spiron black, metal alloy azo dyes, metal salts of naphthenic acid, metal salt of alkylsalicylic acid, fatty acid soaps, resin acid soaps and the like can be considered.

The charge control agent is added in an amount ranging from 0.1 to 10 parts by weight, preferably 0.5 to 5 parts by weight, with respect to 100 parts by weight of the binder resin. Since it is important for the charge control agent to be added to toner for colors to be colorless, quartenary ammonium salts and salts of alkylsalicylic acid are preferred.

Though the particle size of the toner powder is not particularly limited in the present invention, a powder having a volume mean diameter of 3 to 15 $\mu$m is used. In order to obtain high quality images, a small-diametric toner powder of 10 $\mu$m or smaller in volume mean diameter is preferable. Of the above range, small-diametric toner of 5 to 9 $\mu$m is particularly preferable in view of improvement of image quality. However, the configuration of the present invention can be applied to normal electrophotographic toners other than above small-diametric toner. The particle size of the toner powder in that case may be over the above range.

As a production method for the coloring powder constituting the base toner, the kneading and grinding method which comprises the steps of: preparatively mixing the aforementioned binder resin, coloring agent, wax and other additives uniformly by a dry blender, super mixer, ball mill or the like; melting and kneading the resulting mixture uniformly by a kneading machine such as a banbury mixer, roll, uniaxial or biaxial extrusion kneader; then grinding, and grading the kneaded material. There are other methods such as a suspension and polymerization method, and an emulsification and polymerization method. The thus obtained coloring powder is mixed with the above external additives by a mixer like a Henschel mixer, whereby toner of the coloring particles having external additives thereon can be obtained.

Next, the developing method for implementing development with the toner, i.e., the mono-component developer of the present invention will be described. In FIG. 1, 5 designates a photoconductor (electrostatic latent image support) on a drum on the surface of which a static latent image (not shown) is formed, 6 a charger for uniformly charging the surface of the photoconductor 5. Designated at 10 is a developing unit that provides toner to the static latent image formed on photoconductor 5, forming a toner image.

Developing unit 10 has a casing 10*a* that constitutes the main body walls of the developing unit. This casing 10*a* is filled up with the toner (not shown), i.e., the mono-component developer of the present invention and incorporates an agitating vane 4 and a supply roller 3. Also, a developing roller (developer support) 1 and a doctor blade (film thickness control member) 2 are arranged near the opening of casing 10*a*.

Agitating vane 4 agitates and mixes the toner (fresh toner) supplied from an unillustrated hopper arranged on the top of casing 10*a* with the toner (used toner) which has been incasing 10*a*. Supply roller 3 conveys the toner to developing roller 1 and loads the toner onto the developing roller 1 surface.

Developing roller 1 is a developer support that holds the toner as a thin layer on the surface thereof and conveys it to the position where it opposes photoconductor 5. In the present developing unit 10, the developing roller is a contact type which brings the thin toner layer (referred to herein below as toner layer) formed on the developing roller 1 surface into contact with photoconductor 5. The thickness of the toner layer formed on the developing roller 1 surface is regulated by the doctor blade 2 attached at the upper part of the opening of casing 10*a*.

In this case, developing roller 1 preferably comprises an elastic body. Since formation with an elastic body allows developing roller 1 to mitigate the pressing force from doctor blade 2 and the contract pressure with photoconductor 5, toner aggregation can be prevented.

Specifically, the material used for developing roller 1 can be urethane rubber, silicone rubber, NBR (acrylonitrile butadiene rubber), EPDM (ethylene-propylene copolymer), natural rubber, etc., but is not particularly limited.

The linear pressure of doctor blade 2 against developing roller 1 is preferably set at 14.7 N/m to 39.2 N/m. If the linear pressure exceeds 39.2 N/m, stress acting on the toner when the toner is regulated by doctor blade 2 increases so that toner aggregation and fusion of toner to doctor blade 2 take place easily. On the other hand, when the linear pressure is smaller than 14.7 N/m, the thickness of the toner formed on developing roller 1 cannot be well controlled by doctor blade 2 so that density unevenness and other image defects are liable to occur.

The material used for doctor blade 2 can be SUS, aluminum, phosphor bronze etc., but is not particularly limited.

Various examples for confirming the features of the present invention will be shown in contrast with the comparative examples, which clarify the effects of the present invention.

(Measurement of Vickers Hardness):

Each sample for measurement of Vickers hardness was prepared by molding the molten sample material at 180° C. into a cylindrical shape of 5 mm thick using a metal die of 20 mm in diameter. Measurement of Vickers hardness was measured using an ultramicro hardness tester (DUH-W201, SHIMDU CORPORATION) in such a manner that the Vickers indenter was applied with a load of 5 g and maintained for 15 seconds and then the Vickers hardness was determined based on the indentation formed on the sample.

(Production Process of Coloring Powders 1 to 5):

A hundred parts by weight of polyester resin (Mn: 3600, Mw: 40000, Mw/Mn: 11.1, gel content: 2%, Tg: 65° C., softening temperature: 95° C.), 5 parts by weight of carbon black (primary particle size: 18 nm), 2 parts by weight of paraffin wax (melting point: 75° C.), 1 part by weight of a charge control agent (chromium azo complex) were mixed uniformly by a Henschel mixer, heated to be molten and kneaded by a biaxial extruder, then cooled. The thus obtained kneaded material was further ground by a cutting mill, pulverized by a jet mill and finally graded by a classifying machine to provide a coloring powder 1.

The obtained coloring powder 1 had a Vickers hardness of 11. With regard to the particle distribution of base toner 1, the volume mean diameter was 8.5 $\mu$m, the content of particles being 5 $\mu$m or lower in diameter was 2.0% by volume, and the content of toner particles being 16 $\mu$m or greater was 0.8% by volume.

Instead of the polyester resin used for the above coloring powder 1, polyester resins having different softening temperatures were used to produce coloring powders 2 to 5 in the same production process as that of the coloring powder 1. The Vickers hardness and particle distribution of the obtained coloring powders are shown in Table 1 below.

TABLE 1

| | Vickers hardness | Volume mean particle diameter (μm) | Content (% by vol.) of particles of 5 μm or below | Content (% by vol.) of particles of 16 μm or above |
|---|---|---|---|---|
| Coloring powder 1 | 11 | 8.5 | 2.0 | 0.8 |
| Coloring powder 2 | 14 | 8.5 | 1.9 | 0.7 |
| Coloring powder 3 | 16 | 8.5 | 2.1 | 0.9 |
| Coloring powder 4 | 19 | 8.5 | 2.0 | 0.8 |
| Coloring powder 5 | 25 | 8.5 | 1.8 | 0.6 |

(Addition Process of External Additives to Coloring Powders):

One hundred parts by weight of coloring powder 1, 0.5 part by weight of silica having a mean particle diameter of 0.31 μm (amorphous silica KE-P30, a product of NIPPON SHOKUBAI CO., LTD.) as the first external additive and 2.0 parts by weight of hydrophobic silica that had been surface treated with hexamethyldisilazane and had a mean particle diameter of 0.02 μm (H13TM, a product of Clariant International Ltd.) as the second external additive were mixed while agitating by a Henschel mixer to prepare a toner of example 1.

Similarly, five kinds of external additives having different particle sizes shown in Table 2 below and hydrophobic silica that had been surface treated with hexamethyldisilazane and had a mean particle diameter of 0.02 μm (H13TM, a product of Clariant International Ltd.) as the second external additive were used to prepare toners for examples 1 to 15 and comparative examples 1 to 10 shown in Table 3 below.

TABLE 2

| | Trade name | Mean particle diam. (μm) |
|---|---|---|
| External additive 1 | Aerosil RX-50 | 0.04 |
| External additive 2 | Seahostar KE-P10 | 0.11 |
| External additive 3 | Seahostar KE-P30 | 0.31 |
| External additive 4 | Seahostar KE-P50 | 0.54 |
| External additive 5 | Seahostar KE-P100 | 1.10 |

TABLE 3

| | Type of coloring powder | Type of external additive | External additive content (wt. parts) | H13TM content (wt. parts) |
|---|---|---|---|---|
| Example 1 | Coloring powder 1 | External additive 3 | 0.5 | 2.0 |
| Example 2 | Coloring powder 1 | External additive 4 | 0.5 | 2.0 |
| Example 3 | Coloring powder 1 | External additive 5 | 0.5 | 2.0 |
| Example 4 | Coloring powder 2 | External additive 2 | 0.5 | 2.0 |
| Example 5 | Coloring powder 2 | External additive 3 | 0.5 | 2.0 |
| Example 6 | Coloring powder 2 | External additive 4 | 0.5 | 2.0 |
| Example 7 | Coloring powder 3 | External additive 2 | 0.5 | 2.0 |
| Example 8 | Coloring powder 3 | External additive 3 | 0.5 | 2.0 |

TABLE 3-continued

| | Type of coloring powder | Type of external additive | External additive content (wt. parts) | H13TM content (wt. parts) |
|---|---|---|---|---|
| Example 9 | Coloring powder 3 | External additive 4 | 0.5 | 2.0 |
| Example 10 | Coloring powder 4 | External additive 2 | 0.5 | 2.0 |
| Example 11 | Coloring powder 4 | External additive 3 | 0.5 | 2.0 |
| Example 12 | Coloring powder 4 | External additive 4 | 0.5 | 2.0 |
| Example 13 | Coloring powder 5 | External additive 1 | 0.5 | 2.0 |
| Example 14 | Coloring powder 5 | External additive 2 | 0.5 | 2.0 |
| Example 15 | Coloring powder 5 | External additive 3 | 0.5 | 2.0 |
| Comp. Ex. 1 | Coloring powder 1 | External additive 1 | 0.5 | 2.0 |
| Comp. Ex. 2 | Coloring powder 1 | External additive 2 | 0.5 | 2.0 |
| Comp. Ex. 3 | Coloring powder 2 | External additive 1 | 0.5 | 2.0 |
| Comp. Ex. 4 | Coloring powder 3 | External additive 1 | 0.5 | 2.0 |
| Comp. Ex. 5 | Coloring powder 4 | External additive 1 | 0.5 | 2.0 |
| Comp. Ex. 6 | Coloring powder 2 | External additive 5 | 0.5 | 2.0 |
| Comp. Ex. 7 | Coloring powder 3 | External additive 5 | 0.5 | 2.0 |
| Comp. Ex. 8 | Coloring powder 4 | External additive 5 | 0.5 | 2.0 |
| Comp. Ex. 9 | Coloring powder 5 | External additive 4 | 0.5 | 2.0 |
| Comp. Ex. 10 | Coloring powder 5 | External additive 5 | 0.5 | 2.0 |

Next, the conditions for print run tests and the evaluation method will be described.

The print run tests were implemented using a copier AR-C150 (a product of SHARP COOPERATION) with its developing unit modified for non-magnetic mono-component developer. Toners of different combinations shown in Table 3 were used to implement mono-color print run test of 20K (20×1000) sheets (referred to herein below as test) under normal temperature and humidity (20° C./60%) conditions. Evaluation was made based on the image quality (background fog, image density, halftone unevenness) at the initial stage and after 20K prints).

(The Measuring Method of Background Fog Density and its Evaluation Criterion):

A densitometer (X-rite938 (trade name); a product of X-Rite, Incorporated.) was used to measure and evaluate background fog density. The measurement of background fog was carried out as follows. For the background fog measurement, a predetermined area of a clean sheet (which is assumed as the standard and will be called BG sheet herein below) is measured as to density by the aforementioned densitometer. A 5×5 cm solid square pattern is printed out in the upper area of the aforementioned predetermined area on the BG sheet, and then the density of the predetermined area which was once measured (the area under the solid pattern) is measured again by the above densitometer. The differential between the thus obtained density and the original density of BG sheet is defined as the background fog density.

As the criterion of background fog density, the background fog density of lower than 0.015 was evaluated as good.

(The Measuring Method of Image Density and its Evaluation Criterion):

For the measurement of image density, the solid area (100% density pattern) was measured by the above densitometer. As the criterion of image density, image density ranging from 1.40 to 1.60 was evaluated as good.

(The Measuring Method of Halftone Unevenness and its Evaluation Criterion):

The uniformity of the copy of a gray image having an image density of 0.5 to 0.8 was evaluated by visual observation. As the criterion of halftone unevenness, an image free from density unevenness in the halftone image was evaluated as good.

EXAMPLES 1 TO 15

The peripheral speed ratio of the developing roller to the photoconductor was set at 0.90, 20 K sheets run tests were carried out for the toners prepared as specified by examples 1 to 15 shown in Table 3. The test results are shown in Table 4 below. The result showed that image quality was good at both the initial stage and after 20 K prints.

TABLE 4

| | Vickers hardness A | Mean particle size B (μm) | ($A^2 \times B$) value | Image quality (initial) | Image quality (after 20K) |
|---|---|---|---|---|---|
| Example 1 | 11 | 0.31 | 37.5 | Good | Good |
| Example 2 | 11 | 0.54 | 65.3 | Good | Good |
| Example 3 | 11 | 1.10 | 133.1 | Good | Good |
| Example 4 | 14 | 0.11 | 21.6 | Good | Good |
| Example 5 | 14 | 0.31 | 60.8 | Good | Good |
| Example 6 | 14 | 0.54 | 105.8 | Good | Good |
| Example 7 | 16 | 0.11 | 28.2 | Good | Good |
| Example 8 | 16 | 0.31 | 79.4 | Good | Good |
| Example 9 | 16 | 0.54 | 138.2 | Good | Good |
| Example 10 | 19 | 0.11 | 39.7 | Good | Good |
| Example 11 | 19 | 0.31 | 111.9 | Good | Good |
| Example 12 | 19 | 0.54 | 194.9 | Good | Good |
| Example 13 | 25 | 0.04 | 25.0 | Good | Good |
| Example 14 | 25 | 0.11 | 68.8 | Good | Good |
| Example 15 | 25 | 0.31 | 193.8 | Good | Good |

COMPARATIVE EXAMPLES 1 TO 5

The same 20 K sheets run tests as the above examples were carried out for the toners prepared as specified by comparative examples 1 to 5 shown in Table 3. The test results are shown in Table 5 below. The result showed that background fog occurred in the images after 20 K prints.

TABLE 5

| | Vickers hardness A | Mean particle size B (μm) | ($A^2 \times B$) value | Image quality (initial) | Image quality (after 20K) |
|---|---|---|---|---|---|
| Comp. Ex. 1 | 11 | 0.04 | 4.8 | Good | Fog occurred |
| Comp. Ex. 2 | 11 | 0.11 | 13.3 | Good | Fog occurred |
| Comp. Ex. 3 | 14 | 0.04 | 7.8 | Good | Fog occurred |

TABLE 5-continued

| | Vickers hardness A | Mean particle size B (μm) | ($A^2 \times B$) value | Image quality (initial) | Image quality (after 20K) |
|---|---|---|---|---|---|
| Comp. Ex. 4 | 16 | 0.04 | 10.2 | Good | Fog occurred |
| Comp. Ex. 5 | 19 | 0.04 | 14.4 | Good | Fog occurred |

COMPARATIVE EXAMPLES 6 TO 10

The same 20 K sheets run tests as the above examples were carried out for the toners prepared as specified by comparative examples 6 to 10 shown in Table 3. The test results are shown in Table 6 below. The result showed that some halftone unevenness occurred in the images after 20 K prints.

TABLE 6

| | Vickers hardness A | Mean particle size B (μm) | ($A^2 \times B$) value | Image quality (initial) | Image quality (after 20K) |
|---|---|---|---|---|---|
| Comp. Ex. 6 | 14 | 1.10 | 215.6 | Good | Halftone unevenness occurred |
| Comp. Ex. 7 | 16 | 1.10 | 281.6 | Good | Halftone unevenness occurred |
| Comp. Ex. 8 | 19 | 1.10 | 397.1 | Good | Halftone unevenness occurred |
| Comp. Ex. 9 | 25 | 0.54 | 337.5 | Good | Halftone unevenness occurred |
| Comp. Ex. 10 | 25 | 1.10 | 687.5 | Good | Halftone unevenness occurred |

The non-magnetic mono-component toner of the present invention is effective in preventing the external additive particles from sinking into the toner surface as well as from falling off from the surface when the toner particles are stressed in the mono-component developing unit. As a result, it is possible to obtain stable image quality free from degradation of toner charge performance and toner supply performance even for long-term use.

Further, the necessary toner fluidity can be maintained in the mono-component developing unit in which the toner is stressed while improved fluidity can also be obtained under stress-free conditions. Therefore, the present invention has an effect that the toner can be smoothly supplied from the toner cartridge or the toner hopper to the developing roller without stagnation.

Finally, according to the non-magnetic mono-component developing method of the present invention, it is possible to promote easy maintenance and development into compact, light and low-cost configurations as well as provide stable image quality for long term use.

What is claimed is:

1. A non-magnetic mono-component toner composed of a coloring powder at least containing a binder resin, coloring agent and wax and at least one kind of external additive having a mean particle diameter of 0.04 μm or greater, wherein the relationship between the Vickers hardness of the above coloring powder and the mean particle diameter of the external additives is represented by the following expression:

$$21 \leqq A^2 \times B \leqq 195 \quad \text{(Eq.1)}$$

A: the Vickers hardness of the coloring powder

B: the mean particle diameter ($\mu$m) of the external additives.

2. The non-magnetic mono-component toner according to claim 1, further containing a micro powder having a volume mean particle diameter of 0.03 $\mu$m or lower as the second external additive.

3. A non-magnetic mono-component developing method which uses a developer support for bearing a thin layer of a toner, forming a mono-component developer, on the surface thereof, a layer thickness control member arranged in abutment with the developer support for making the thickness of the thin layer held on the developer support surface uniform, and brings the developer support into contact with an electrostatic latent image support on which an electrostatic latent image is formed so as to develop the electrostatic latent image, wherein the mono-component toner employs a non-magnetic mono-component toner composed of a coloring powder at least containing a binder resin, coloring agent and wax and at least one kind of external additive having a mean particle diameter of 0.04 $\mu$m or greater, and being characterized in that the relationship between the Vickers hardness of the above coloring powder and the mean particle diameter of the external additives is represented by the following expression:

$$21 \leqq A^2 \times B \leqq 195 \quad \text{(Eq.1)}$$

A: the Vickers hardness of the coloring powder

B: the mean particle diameter ($\mu$m) of the external additives.

4. The non-magnetic mono-component developing method according to claim 3, wherein the non-magnetic mono-component toner further contains a micro powder having a volume mean particle diameter of 0.03 $\mu$m or lower as the second external additive.

* * * * *